US005642037A

United States Patent [19]

Malherbe

[11] Patent Number: 5,642,037

[45] Date of Patent: Jun. 24, 1997

[54] INTEGRATED CIRCUIT WITH FAST STARTING FUNCTION FOR REFERENCE VOLTAGE OF REFERENCE CURRENT SOURCES

[75] Inventor: Alexandre Malherbe, Trets, France

[73] Assignee: SGS-Thomson Microelectronics S.A., Saint Genis, France

[21] Appl. No.: 521,516

[22] Filed: Aug. 30, 1995

[30] Foreign Application Priority Data

Aug. 31, 1994 [FR] France ..... 94 10500

[51] Int. Cl.[6] ..... G05F 3/16

[52] U.S. Cl. ..... 323/316; 323/315; 323/317; 327/541; 327/544

[58] Field of Search ..... 327/541, 544; 323/315, 316, 317

[56] References Cited

U.S. PATENT DOCUMENTS 4,628,250 12/1986 Lee ..... 323/317
5,047,706 9/1991 Ishibashi et al. ..... 323/313
5,258,663 11/1993 Tamaki ..... 307/296.5
5,281,866 1/1994 Rundel ..... 307/296.3

FOREIGN PATENT DOCUMENTS 0 511 675 11/1992 European Pat. Off. ..... G05F 3/24

*Primary Examiner*—Peter S. Wong
*Assistant Examiner*—Shawn Riley
*Attorney, Agent, or Firm*—Wolf, Greenfield & Sacks, P.C.; James H. Morris

[57] ABSTRACT

A reference level generator in integrated circuit form comprises at least one first current circulation arm in which there are, in series, an N channel transistor and a P channel transistor, one of which is referred to as a reference transistor. The reference transistor has a drain connected to a gate in normal mode, the gate being connected to an output of the generator. Standby mode transistors are interposed between each current circulation arm and a supply terminal, and a mode control input gives a mode signal that turns the standby transistors off in standby mode and turns the standby transistors on in normal mode. A transistor controlled by the mode signal may be connected between the output and a non-floating reference potential, or a pass-gate may be inserted between the gate and the drain of the reference transistor, this gate being controlled by the mode signal to be off in the standby mode.

44 Claims, 2 Drawing Sheets

INTEGRATED CIRCUIT WITH FAST STARTING FUNCTION FOR REFERENCE VOLTAGE OF REFERENCE CURRENT SOURCES

BACKGROUND OF THE INVENTION

1. Field of the Invention

The invention relates to integrated circuits, and more particularly to reference voltage or current generators.

2. Discussion of the Related Art

Many integrated circuits now work in a normal mode and in a standby mode with reduced consumption. This standby mode is implemented when the circuit does not need to perform all the normal functions for which it is designed. All that the circuit does then is to watch for the appearance of an event that should reactivate the normal functions. In this standby mode, it is desirable that the normal functions should not consume current unnecessarily.

This is why it is now common practice to disconnect a certain number of circuit arms that might consume current unnecessarily in standby mode. The standby mode is defined by a determined logic state, 0 or 1, of a logic signal present at an internal node or at an external access terminal of the circuit. This logic signal is used to control switches that cut off the current consumption in the different arms of the integrated circuit.

As in the case of the other functions of the integrated circuit, it is appropriate to cut off the current consumption of reference voltage or current generators, in the integrated circuit, when in standby mode. These generators are the circuit elements that give the stable levels of voltage or current needed for the operation of the other elements of the integrated circuit. However, it is generally necessary that these generators should restart very swiftly and in a controlled way (especially without oscillation) when the circuit goes back into normal operation mode. It is indeed indispensable that these generators should not give uncontrolled random states during the time when the normal mode is being restored.

In the same way, these reference voltage generators should not give uncontrolled levels during the stages when the integrated circuit is subjected to power-on reset operations, i.e. when the circuit is powered again after its supply has been cut off.

A system has been devised where the current consumption in these reference generators is controlled by a logic signal that may be called "POR-STBY". When this signal is at 1, the system is in standby mode. When it is at 0, the system is in normal mode. And furthermore this signal undergoes a transition from 1 to 0, set up by a power-on-reset circuit when the supply voltage of the integrated circuit returns to a sufficient level after a brief or long-lasting cut.

A reference voltage (or reference current) generator, in CMOS technology, conventionally has at least one current circulation arm in which there are an N channel transistor and a P channel transistor in series, one of the two transistors having its gate connected to its drain. In general, there are at least two arms of this type, and the two arms are coupled so as to set up mutual copies of current which are the basis of the structure of such reference generators.

FIG. 1 shows a typical example of a reference generator comprising four transistors, P1, P2 (P channel transistors) and N1, N2 (N channel transistors). The P channel transistors have their gates joined together and their sources connected to a supply terminal A at a potential Vdd. The N channel transistors have their gates connected together and their sources connected to a ground terminal B. The drains of P1 and N1 are connected to form a first current arm. The drains of P2 and N2 are connected to form a second current arm. The gate of P1 is connected to its drain and forms a first output S1 giving a first reference voltage VrefP. The gate of N2 is connected to its drain and forms a second output S2 giving a second reference voltage VrefN.

The circuit of FIG. 1 is therefore a double generator of reference voltages. It is used when it is desired to produce two reference voltages close to the threshold voltages of the N and P transistors respectively of the integrated circuit. There are many other examples of generators giving one or more reference voltages.

FIG. 2 shows a proposal already made for cutting off the consumption of the reference generator of FIG. 1 in standby mode and for restarting on the trailing edge of the logic signal POR-STBY. This trailing edge appears after a standby or after an operation to restore the supply voltage Vdd.

This proposal entails:

inserting two transistors Q1 and Q2 respectively in the arm P1, N1 and in the arm P2, N2, these transistors being off in standby mode and conductive in normal mode. For example, they are P channel transistors inserted between the transistors P1, P2 and the terminal A at Vdd and controlled by the signal POR-STBY, or else they are N channel transistors inserted between N1, N2 and the ground and controlled by the signal NPOR-STBY which is the logic complement of the control signal POR-STBY generated by inverter INV;

using a low threshold voltage transistor D1 to short-circuit the two reference outputs S1 and S2 to give them an intermediate common potential during the standby;

and placing a capacitor C between the input POR-STBY and the gates of transistors P1 and P2, or between the control signal NPOR-STBY and the gates of transistors N1 and N2.

The transistors Q1 and Q2 cut off the consumption. The transistor D1 makes it possible for the outputs S1 and S2 to start from one and the same mean level at the time of a power-on-reset or restarting operation. The capacitor C makes it possible to heavily unbalance the circuit at the time of the power-on-reset operation (on the trailing edge of POR-STBY) to prevent the reference generator from recovering its normal state far too slowly, especially when the transistors that form it are highly resistive, which is often the case.

It has been observed that one drawback of this circuit is the fact that the output nodes S1 and S2 are at floating potentials in standby mode. If this potential were to be truly in the middle of the interval between the levels VrefN and VrefP, this could be acceptable. But, this is not certain. Furthermore, the capacitor C takes up a great deal of space on the integrated circuit. Finally, this circuit works on condition that the supply voltage Vdd present at the time of the trailing edge POR-STBY is high enough. Now, it is increasingly sought to have circuits that work even at very low supply voltages, especially circuits for which the power-on-reset operation is ensured for a small level of Vdd (about 2 volts approximately) after cut-off.

SUMMARY OF THE INVENTION

The present invention is related to the case of the placing reference voltage or current generators in integrated circuits into standby mode.

The invention therefore proposes a (voltage or current) reference level generator comprising at least one first current circulation arm in which there are, in series, an N channel transistor and a P channel transistor, one of the two transistors, hereinafter called a reference transistor, having its drain connected to its gate in normal mode and this gate being connected to an output of the generator, standby mode transistors interposed between each current circulation arm and a supply terminal, and a mode control input to give a mode signal that turns the standby transistors off in standby mode and turns them on in normal mode, wherein, a transistor controlled by the mode signal is connected between the output and a non-floating reference potential (preferably a supply terminal or the ground) and, a pass-gate is inserted between the gate and the drain of the reference transistor, this gate being controlled by the mode signal to be off in standby mode.

The term "pass-gate" is understood to mean a switch that is on or off and, when on, introduces a very low voltage drop. In practice, a pass-gate is formed by two transistors having opposite types of conductivity, placed in parallel and controlled by complementary logic signals (here, the mode signal and its complement).

The invention is applicable notably to a voltage generator such as that of FIG. 1, comprising two current circulation arms having series-connected transistors of opposite types in each arm, the transistors of the two arms being mounted so that each arm copies the current in the other arm.

If there are two reference outputs, as is the case for the generator of FIG. 1, each of the outputs can be placed at a non-floating potential level in standby mode, but it is not necessary to cut the gate-drain link of the reference transistor of each of the arms by means of a pass-gate. In contrast, only one link may be cut. The link that is cut is the one for which there is a risk of introducing a current consumption path in standby mode. This depends firstly on the non-floating potentials to which the outputs are connected in standby mode and, secondly, on the position of the transistors in standby mode since these transistors may be connected to either one of the supply terminals (ground or supply voltage Vdd).

Finally, should it be desired that the outputs of the generator be linked in standby mode to a potential that is not the one most suited to a swift restarting of the generator, the gates of the reference transistors are connected, in standby mode, to the potentials most suited to a swift restarting or power-on-reset operation. Furthermore, pass-gates that are on in normal mode and off in standby mode are interposed between these gates and the outputs of the generator, and the outputs are connected to the desired potentials by means of transistors that are off in normal mode and on in standby mode.

BRIEF DESCRIPTION OF THE DRAWINGS

Other features and advantages of the invention shall appear from the following detailed description, made with reference to the appended figures, of which.

DETAILED DESCRIPTION

In particular, the present invention is directed to providing a comprehensive solution to the problems of the related art, and especially to obtaining a swift and sure restarting of the generator after a supply cut-off or after a period of standby. The invention proposes first, as was done hitherto, to interpose transistors between the arms of the current generator and the ground or the supply terminal at Vdd. The invention also proposes to connect the outputs of the reference generator to reference potentials in standby mode; in practice these potentials are the supply potentials of the terminals A and B. Finally, the invention proposes to use a respective transfer gate to cut off that gate-drain link or those gate-drain links of the transistors of the generator that set up current consumption paths between the supply terminals A and B because the outputs are connected to the reference potentials instead of remaining in a floating state.

In other words, contrary to the general principle of standby circuits whereby it is only the links to the ground or to Vdd that are cut, in this case there is a deliberate addition of additional links to one of the ground and to the supply terminal at Vdd within the generator circuit. Further, another switch (or many other switches) are positioned elsewhere to compensate for this addition.

Figure 1:
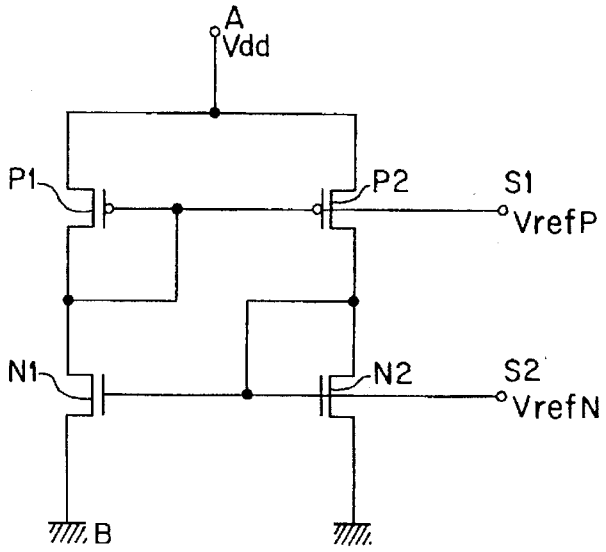
FIG. 1 (PRIOR ART)
FIG. 1 already described, shows a diagram of a related art reference current or reference voltage generator.
Figure 2:
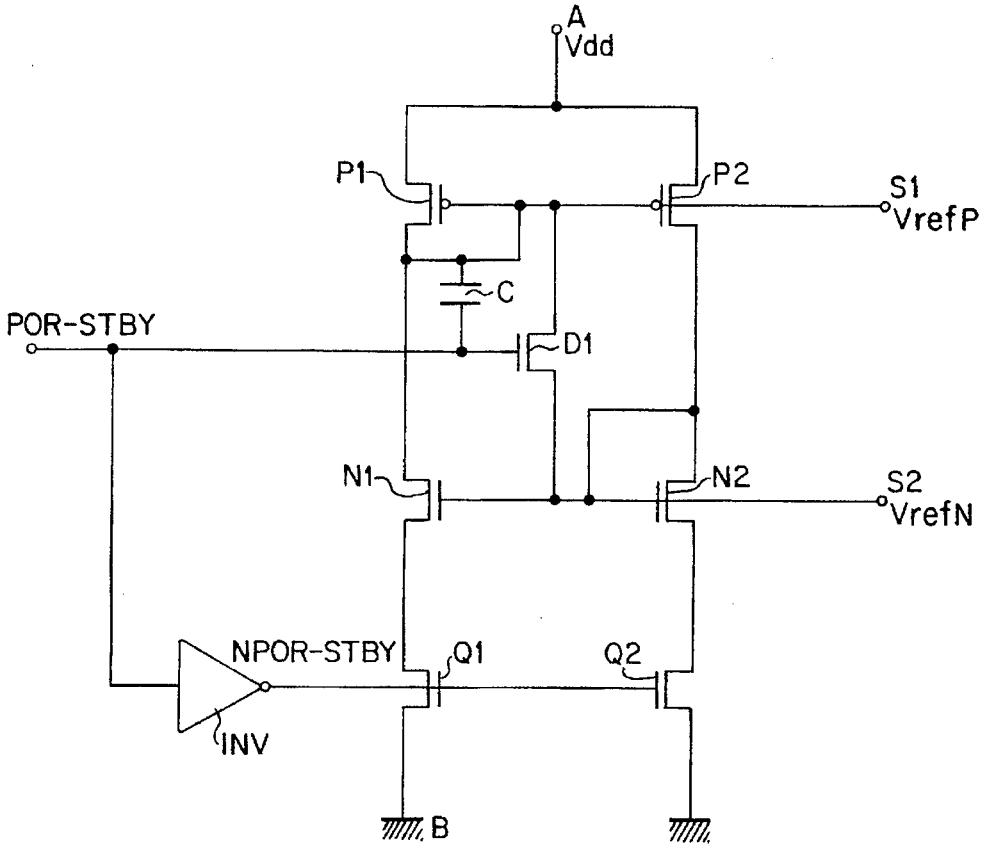
FIG. 2 (PRIOR ART)
FIG. 2 already described, shows a diagram of a related art generator with a standby mode.
Figure 3:
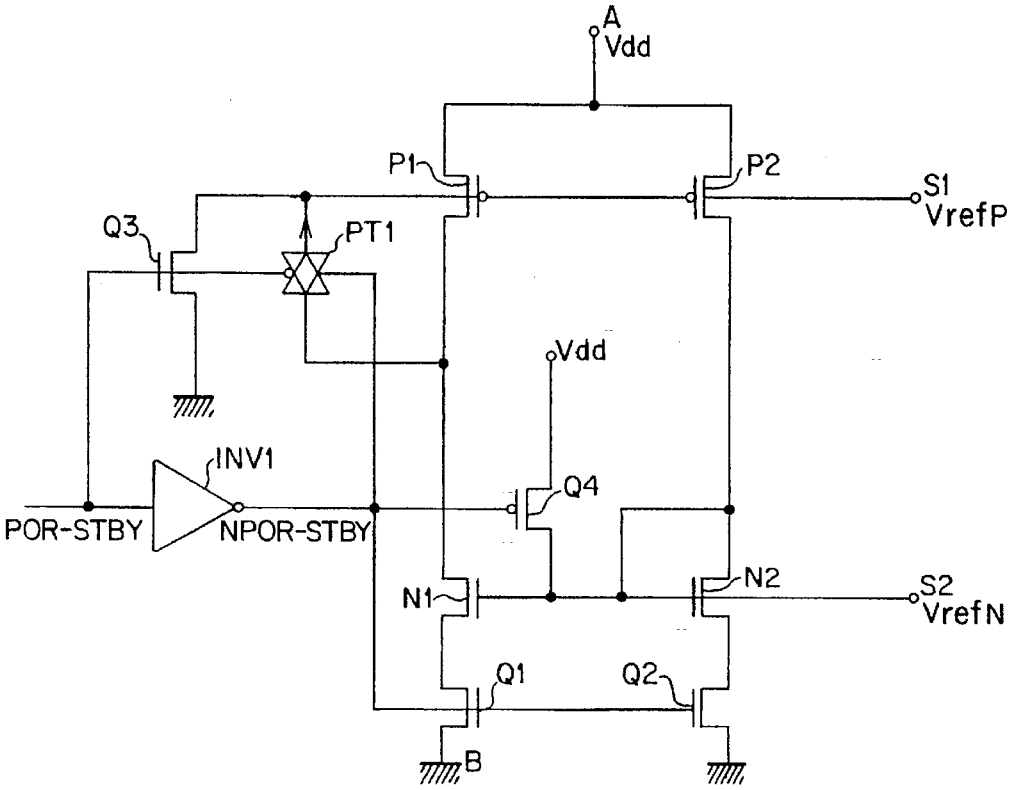
FIG. 3 shows a diagram of a reference generator according to an illustrative embodiment of the invention.

In one illustrative embodiment, the reference current or voltage generator of FIG. 3 is built from the basic diagram of FIG. 1. Starting from another basic diagram, the manner of the implementing the present invention can easily be deduced from the following explanations.

It will be understood that it is possible to use the terms "reference voltage generator" or "reference current generator" without distinction since voltage and current are indissolubly linked in this type of diagram: on the one hand, the reference voltage given is a transistor gate-source voltage and therefore directly represents the current flowing through this transistor. On the other hand, this reference voltage is generally used to control current sources whose function is to copy the current flowing through the transistor, this current therefore being a reference current.

In FIG. 3, the elements common with FIG. 1 bear the same references and the explanations given with respect to FIG. 1 remain valid.

The generator shown in FIG. 3 has two current circulation arms supplied between the supply terminals A (Vdd) and B (the ground). Each arm has at least two series-connected transistors, P1 and N1 for the first arm, P2 and N2 for the second arm. However, there could be more than two transistors in each arm, in addition to the transistors specifically added on for the standby mode. N1 and N2 are N channel transistors and P1 and P2 are P channel transistors.

The transistors of the arms are mounted so that each arm copies the current of the other arm. This is a standard arrangement, but other more complex structures are possible and within the scope of this disclosure.

To carry out this mutual copying operation, the transistors P1 and P2 may be mounted as a current mirror, with P2 copying the current in P1, and the transistors N1 and N2 may be mounted as a current mirror, with N1 copying the current of N2.

For this purpose, the transistors P1 and P2 have their gates connected together and their sources connected to the same potential, in this case the potential Vdd of the terminal A. The transistor P1, as shall be seen, has its gate connected to its drain in normal operation mode but its gate disconnected from its drain in standby mode. To this end, a pass-gate PT1 is inserted into the gate-drain link of P1.

The transistors N1 and N2 have their gates joined together and their sources connected to one and the same potential in normal operation. This potential is the ground potential.

However, transistors Q1 and Q2 are interposed in the source-ground links of the transistors N1 and N2. When these transistors are on (normal mode), the sources of N1 and N2 are practically at the ground potential and the two arms (P1, N1) and (P2, N2) fulfill their role of the mutual copying of current. When they are off, the current is cut off in the two arms and these arms no longer fulfil their mutual current-copying role. The drain of N2 is connected to its gate.

The generator has two outputs S1 and S2 that are taken at the gate connection of P1, P2 (output S1 giving a reference voltage VrefP in normal mode) and at the gate connection of N1, N2 (output S2 giving a reference voltage VrefN in normal mode). The transistors Q1 and Q2 are, in this example, N channel transistors mounted between the transistors N1 and N2 and the ground. It shall be seen that they could equally well be P channel transistors mounted between the transistors P1 and P2 and the terminal A. They should then be controlled by a logic level that is the reverse of the case shown in FIG. 3.

The circuit has a mode control input for a mode signal POR-STBY.

In the example described, it is assumed that this signal POR-STBY is at the logic level 1 in standby mode and at the logic level 0 in normal mode. This signal undergoes a trailing transition of 1 to 0 during the change in mode or also when a power-on-reset circuit (not shown) has detected the fact that the supply voltage has again become sufficient after an interruption. The signal POR-STBY is therefore a signal obtained both from a mode change command and from the output of a power-on-reset circuit.

An inverter INV1 gives a logic level NPOR-STBY that is complementary to the signal POR-STBY.

The transistors Q1 and Q2 are controlled by the output NPOR-STBY of the inverter INV1 since they are typically on in normal mode and off in standby mode.

The pass-gate PT1 may be controlled by the signals POR-STBY and NPOR-STBY so as to be on in normal mode and off in standby mode.

It is furthermore provided that the outputs S1 and S2 will be placed at non-floating potentials in standby mode. This is in order to enable a speedier restarting of the generator at the return to normal mode and also, if necessary, to enable the use of the outputs S1 and S2 for logic purposes on the following stages, even in standby mode.

To this end, a transistor Q3 and a transistor Q4 enable the connection, in standby mode, of one of the outputs S1, S2 to the ground and the other to Vdd.

In the example shown, the transistor Q3 is connected between the output S1 and the ground. It is an N channel transistor controlled by the signal POR-STBY. And a transistor Q4 is connected between the output S2 and the terminal A at Vdd. It is a P channel transistor controlled by the complementary signal NPOR-STBY.

The following is the role of the pass-gate PT1:

If it were not there to cut the drain-gate link of P1 in standby mode, a current path may exist between the terminal A and the ground by means of the transistor P1 (which is on because of the grounding of its gate by Q3), the drain-gate link of P1, and the transistor Q3 which grounds the gate P1. Through the blocking of the gate-drain link in standby mode, this current consumption path is cut without preventing the grounding of the output S1.

It will be noted that it is not necessary to provide for a similar pass-gate in the gate-drain link of the transistor N2. However, if the transistors Q1 and Q2 were to be inserted between the transistors P1 and P2 and the terminal A instead of being connected between N1 and N2 and the ground, then it is the gate-drain link of N2 and not the gate-drain link of P1 that should have a pass-gate.

With the embodiment shown in the diagram of FIG. 3, there is obtained a restarting of the generator that is fast and oscillation-free, whether during the passage into normal mode after standby or in a power-on-reset operation.

It is possible that what is sought at the outputs of the generator in standby mode is not a 0 level on S1 and a 1 level on S2 but the contrary. Also, it may be desired to have other reference levels on S1 and S2 in standby mode. However, to ensure a swift restarting of the generator, the most appropriate potentials are a potential of 0 at the gate of the transistor P1 (terminal S1) and a potential Vdd at the gate of the transistor N1 (terminal S2).

Figure 4:
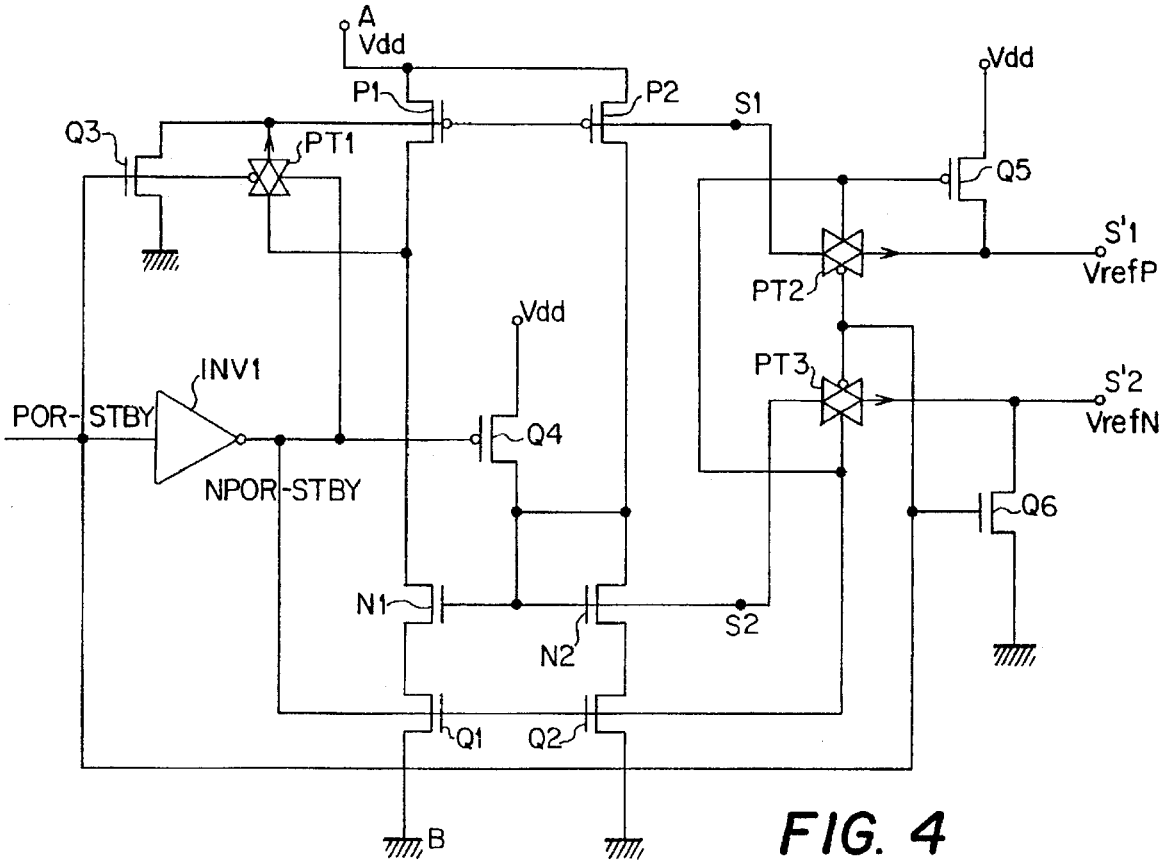
FIG. 4 shows a diagram of another illustrative embodiment of the invention.

In this case, an embodiment shown in the diagram of FIG. 4 may be used. The elements are the same as in FIG. 3 but pass-gates PT2 and PT3 are added on, downline with respect to the outputs S1 and S2. These gates, controlled by the signal POR-STBY and its complement NPOR-STBY, are on in normal mode and introduce a very small drop in voltage. At the outputs S'1 and S'2, therefore, there are obtained practically the same reference voltages VrefP and VrefN as at S1 and S2. S'1 and S'2 are then used as the real outputs of the reference level generator. Two transistors Q5 and Q6, conductive only in standby mode, are then added on to connect the outputs S'1 and S'2 to the desired potentials in standby mode. Herein, Q5 is a P channel transistor connecting S'1 to Vdd in standby mode. Q5 is controlled by NPOR-STBY. And Q6 is an N channel transistor connecting S'2 to the ground in standby mode. Q6 is controlled by POR-STBY.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereto.

What is claimed is:

1. A reference level generator in integrated circuit form, the reference level generator operating in either of a normal mode or a standby mode, the reference level generator comprising:

at least one current circulation arm, each at least one current circulation arm having two transistors including an n channel transistor and a p channel transistor connected in series, one of the two transistors being a reference transistor having a gate terminal that is connected to a drain terminal when the reference level generator is operating in the normal mode, the gate terminal of each reference transistor of each at least one circulation arm providing an output of the reference level generator;

at least one standby mode transistor interposed between each at least one circulation arm and a supply terminal, the at least one standby mode transistor being responsive to a mode control input to be in an on state when the reference level generator is operating in the normal mode and in an off state when the reference level generator is operating in the standby mode; and a coupling transistor that couples the output of each at least one circulation arm of the reference level generator to a non-floating reference potential.

2. The reference level generator of claim 1, wherein the reference level generator has a supply terminal, and wherein the non-floating reference potential is the supply terminal.

3. The reference level generator of claim 1, wherein the at least one current circulation arm includes:

a first current circulation arm that generates a first current; and a second current circulation arm that generates a second current that is substantially equal to the first current.

4. The reference level generator of claim 3, wherein:

the gate terminal of the reference transistor of the first current circulation arm provides a first output of the reference level generator;

the first current circulation arm includes a pass gate coupled between the drain terminal of the reference transistor and the gate terminal of the reference transistor; and the gate terminal of the reference transistor of the second current circulation arm provides a second output of the reference level generator.

5. The reference level generator of claim 4, wherein the reference level generator has a first supply terminal and a second supply terminal, and wherein the coupling transistor includes:

a first coupling transistor that couples the first output of the reference level generator to the first supply terminal; and a second coupling transistor that couples the second output of the reference level generator to the second supply terminal.

6. The reference level generator of claim 4, further comprising:

a first output pass-gate that couples the gate terminal of the reference transistor of the first current circulation arm to the first output when the reference level generator is operating in the normal mode;

a second output pass-gate that couples the gate terminal of the reference transistor of the second current circulation arm to the second output when the reference level generator is operating in the normal mode;

a first output transistor that couples the first output to a first desired potential when the reference level generator is operating in the standby mode; and a second output transistor, that couples the second output to a second desired potential when the reference level generator is operating in the standby mode.

7. The reference level generator of claim 1, further comprising:

an output pass-gate that couples the gate terminal of the reference transistor to the output when the reference level generator is operating in the normal mode; and an output transistor that couples the output to a desired potential when the reference level generator is operating in the standby mode.

8. A reference voltage generator that operates in a first mode and a second mode, the reference voltage generator comprising:

a first reference voltage generator having an output that provides an output reference voltage when the reference voltage generator is operating in the first mode; and a first coupling device that couples the output of the first reference voltage generator to a first input voltage when the reference voltage generator is operating in the second mode and that decouples the output of the first reference voltage generator from the first input voltage when the reference voltage generator is operating in the first mode.

9. The reference voltage generator of claim 8, wherein the first reference voltage generator is coupled between a first voltage source and a second voltage source, the first reference voltage generator including a standby transistor that couples the first reference voltage generator to the first voltage source when the reference voltage generator is operating in the first mode and that isolates the first reference voltage generator from the first voltage source when the reference voltage generator is operating in the second mode.

10. The reference voltage generator of claim 9, wherein the first input voltage is the first voltage source.

11. The reference voltage generator of claim 8, wherein the first reference voltage generator includes a reference transistor having a gate terminal and a drain terminal, the reference voltage generator further including a pass gate that couples the gate terminal to the drain terminal when the reference voltage generator is operating in the first mode and that decouples the gate terminal from the drain terminal when the reference voltage generator is operating in the second mode.

12. The reference voltage generator of claim 8, further comprising an output pass-gate that couples the output to an output terminal when the reference voltage generator is operating in the first mode.

13. The reference voltage generator of claim 12, further comprising an output transistor that couples the output terminal to a second input voltage when the reference voltage generator is operating in the second mode.

14. The reference voltage generator of claim 8, further comprising:

a second reference voltage generator having an output that provides a second output reference voltage when the reference voltage generator is operating in the first mode; and a second coupling device that couples the output of the second reference voltage generator to a second input voltage when the reference voltage generator is operating in the second mode and that decouples the second output terminal from the first input voltage when the reference voltage generator is operating in the first mode.

15. The reference voltage generator of claim 14, wherein the first reference voltage generator and the second reference voltage generator are each coupled between a first voltage source and a second voltage source, the reference voltage generator further comprising:

a first standby transistor that couples the first reference voltage generator to the first voltage source when the reference voltage generator is operating in the first mode and that isolates the first reference voltage generator from the first voltage source when the reference voltage generator is operating in the second mode; and a second standby transistor that couples the second reference voltage generator to the first voltage source when the reference voltage generator is operating in the first mode and that isolates the first reference voltage generator from the first voltage source when the reference voltage generator is operating in the second mode.

16. The reference voltage generator of claim 15, wherein the first input voltage is the first voltage source and the second input voltage is the second voltage source.

17. The reference voltage generator of claim 14, wherein the first reference voltage generator includes a reference transistor having a gate terminal and a drain terminal, the reference voltage generator further including a pass gate that couples the gate terminal to the drain terminal when the reference voltage generator is operating in the first mode and that decouples the gate terminal from the drain terminal when the reference voltage generator is operating in the second mode.

18. The reference voltage generator of claim 14, further comprising:

a first output pass-gate that couples the output of the first reference voltage generator to a first output terminal when the reference voltage generator is operating in the first mode; and a second output pass-gate that couples the output of the second reference voltage generator to a second output terminal when the reference voltage generator is operating in the first mode.

19. The reference voltage generator of claim 18, further comprising:

a first output transistor that couples the first output terminal to the second input voltage when the reference voltage generator is operating in the second mode; and a second output transistor that couples the second output terminal to the first input voltage when the reference voltage generator is operating in the second mode.

20. A reference voltage generator that operates in a first mode and a second mode, the reference voltage generator comprising:

a first reference voltage generator having an output that provides an output reference voltage at a first output terminal when the reference voltage generator is operating in the first mode; and means for coupling the first output terminal to a first input voltage when the reference voltage generator is operating in the second mode and for decoupling the first output terminal from the first input voltage when the reference voltage generator is operating in the first mode.

21. The reference voltage generator of claim 20, wherein the first reference voltage generator is coupled between a first voltage source and a second voltage source, the reference voltage generator further comprising means for isolating the first reference voltage generator from the first voltage source when the reference voltage generator is operating in the second mode.

22. The reference voltage generator of claim 21, wherein the first input voltage is the first voltage source.

23. The reference voltage generator of claim 20, wherein the first reference voltage generator includes a transistor having an on state and an off state, the reference voltage generator further comprising means for controlling the transistor to be in the on state when the reference voltage generator is operating in the first mode and for controlling the transistor to be in the off state when the reference voltage generator is operating in the second mode.

24. The reference voltage generator of claim 20, further comprising an output pass-gate that couples the first output terminal to a second output terminal when the reference voltage generator is operating in the first mode.

25. The reference voltage generator of claim 24, further comprising an output transistor that couples the second output terminal to a second input voltage when the reference voltage generator is operating in the second mode.

26. The reference voltage generator of claim 20, further comprising:

a second reference voltage generator having an output that provides a second output reference voltage at a second output terminal when the reference voltage generator is operating in the first mode; and means for coupling the second output terminal to a second input voltage when the reference voltage generator is operating in the second mode and for decoupling the second output terminal from the second input voltage when the reference voltage generator is operating in the first mode.

27. The reference voltage generator of claim 26, wherein:

the first reference voltage generator is coupled between a first voltage source and a second voltage source, the reference voltage generator further comprising means for isolating the first reference voltage generator from the first voltage source when the reference voltage generator is operating in the second mode; and the second reference voltage generator is coupled between the first voltage source and the second voltage source, the reference voltage generator further comprising means for isolating the second reference voltage generator from the first voltage source when the reference voltage generator is operating in the second mode.

28. The reference voltage generator of claim 27, wherein the first input voltage is the first voltage source and the second input voltage is the second voltage source.

29. The reference voltage generator of claim 26, wherein the first reference voltage generator includes a transistor having an on state and an off state, the reference voltage generator further comprising means for controlling the transistor to be in the on state when the reference voltage generator is operating in the first mode and for controlling the transistor to be in the off state when the reference voltage generator is operating in the second mode.

30. The reference voltage generator of claim 26, wherein the second reference voltage generator includes a transistor having an on state and an off state, the reference voltage generator further comprising means for controlling the transistor to be in the on state when the reference voltage generator is operating in the first mode and for controlling the transistor to be in the off state when the reference voltage generator is operating in the second mode.

31. The reference voltage generator of claim 26, further comprising;

a first output pass-gate that couples the first output terminal to a third output terminal when the reference voltage generator is operating in the first mode; and a second output pass-gate that couples the first second output terminal to a fourth output terminal when the reference voltage generator is operating in the first mode.

32. The reference voltage generator of claim 31, further comprising:

a first output transistor that couples the third output terminal to the second input voltage when the reference voltage generator is operating in the second mode; and a second output transistor that couples the fourth output terminal to the first input voltage when the reference voltage generator is operating in the second mode.

33. A method for controlling a reference voltage generator to operate in a first mode and a second mode, the method comprising the steps of:

generating a first reference voltage at a first output terminal when the reference voltage generator is operating in the first mode;

coupling the first output terminal to a first input voltage when the reference voltage generator is operating in the second mode; and decoupling the first output terminal from the first input voltage when the reference voltage generator is operating in the first mode.

34. The method of claim 33, wherein the step of generating includes coupling the reference voltage generator between a first voltage source and a second voltage source, the method further comprising a step of isolating the reference voltage generator from the first voltage source when the reference voltage generator is operating in the second mode.

35. The method of claim 34, wherein the step of coupling the first output terminal to a first input voltage includes coupling the first output terminal to the first voltage source.

36. The method of claim 33, wherein the reference voltage generator includes a reference transistor having a drain terminal and a gate terminal, the method further comprising the steps of:

coupling the drain terminal to the gate terminal when the reference voltage generator is operating in the first mode; and isolating the drain terminal from the gate terminal when the reference voltage generator is operating in the second mode.

37. The method of claim 33, further comprising the step of coupling the first output terminal to a second output terminal when the reference voltage generator is operating in the first mode.

38. The method of claim 37, further comprising the steps of:

decoupling the second output terminal from the first output terminal when the reference voltage generator is operating in the second mode; and coupling the second output terminal to a second input voltage when the voltage generator is operating in the second mode.

39. The method of claim 33, further comprising the steps of:

generating a second reference voltage at a second output terminal when the reference voltage generator is operating in the first mode;

coupling the second output terminal to a second input voltage when the reference voltage generator is operating in the second mode; and decoupling the second output terminal from the second input voltage when the reference voltage generator is operating in the first mode.

40. The method of claim 39, wherein the step of generating a first reference voltage includes coupling the reference voltage generator between a first voltage source and a second voltage source, the method further comprising a step of isolating the reference voltage generator from the first voltage source when the reference voltage generator is operating in the second mode.

41. The method of claim 39, wherein:

the step of coupling the first output terminal to the first input voltage includes coupling the first output terminal to the first voltage source; and the step of coupling the second output terminal to the second input voltage includes coupling the second output terminal to the second voltage source.

42. The method of claim 39, wherein the reference voltage generator includes a reference transistor having a drain terminal and a gate terminal, the method further comprising the steps of:

coupling the drain terminal to the gate terminal when the reference voltage generator is operating in the first mode; and isolating the drain terminal from the gate terminal when the reference voltage generator is operating in the second mode.

43. The method of claim 39, further comprising the steps of:

coupling the first output terminal to a third output terminal when the reference voltage generator is operating in the first mode; and coupling the second output terminal to a fourth output terminal when the reference voltage generator is operating in the first mode.

44. The method of claim 43, further comprising the steps of:

decoupling the third output terminal from the first output terminal when the reference voltage generator is operating in the second mode;

coupling the third output terminal to the second input voltage when the voltage generator is operating in the second mode;

decoupling the fourth output terminal from the second output terminal when the reference voltage generator is operating in the second mode; and coupling the fourth output terminal to the first input voltage when the voltage generator is operating in the second mode.

* * * * *